US007157043B2

(12) United States Patent
Neff

(10) Patent No.: US 7,157,043 B2
(45) Date of Patent: Jan. 2, 2007

(54) BONDED PARTICLE FILTERS

(75) Inventor: David Neff, Willoughby, OH (US)

(73) Assignee: Pyrotek, Inc., Spokane, WA (US)

( * ) Notice: Subject to any disclaimer, the term of this patent is extended or adjusted under 35 U.S.C. 154(b) by 399 days.

(21) Appl. No.: 10/659,817

(22) Filed: Sep. 11, 2003

(65) Prior Publication Data

US 2004/0123970 A1 Jul. 1, 2004

Related U.S. Application Data

(60) Provisional application No. 60/410,787, filed on Sep. 13, 2002.

(51) Int. Cl.
*C21B 3/04* (2006.01)

(52) U.S. Cl. ..... 266/230; 266/227

(58) Field of Classification Search ..... 266/227, 266/230; 164/134, 359
See application file for complete search history.

(56) References Cited

U.S. PATENT DOCUMENTS 4,220,319 A 9/1980 Rohmann
4,964,993 A * 10/1990 Stankiewicz ..... 210/510.1
5,031,805 A 7/1991 Rohmann
5,370,177 A 12/1994 Fey et al.
5,477,907 A 12/1995 Meyer et al.
5,908,065 A 6/1999 Chadwick
5,913,358 A 6/1999 Chadwick
6,203,593 B1 * 3/2001 Tanuma et al. ..... 266/227
6,289,969 B1 * 9/2001 Outten et al. ..... 164/134

* cited by examiner

*Primary Examiner*—Scott Kastler
(74) *Attorney, Agent, or Firm*—Fay, Sharpe, Fagan, Minnich & McKee, LLP

(57) ABSTRACT

An apparatus for filtering molten metal held in a vessel before the metal enters the dosing tube. The filtering apparatus includes an attachment portion that mounts to the dosing tube, a filter body connected to the attachment portion and a planar surface attached to an end of the filter body opposite the attachment portion. The filter body can include a beveled end opposite the attachment portion where the planar surface is attached. The apparatus can be made from a bonded-particle material made from silicon carbide or aluminum oxide held together by an aluminum-resistant binder.

13 Claims, 2 Drawing Sheets

BONDED PARTICLE FILTERS

This application claims priority to U.S. Provisional Application Ser. No. 60/410,787 filed Sep. 13, 2002.

FIELD OF THE INVENTION

The present invention relates to metal casting. More particularly, an apparatus for filtering molten metal before it enters an outlet or dosing tube of a vessel or dosing furnace.

BACKGROUND OF THE INVENTION

In casting of ferrous and non-ferrous products, metal is melted in a melting furnace. The metal is transferred from the melting furnace into a dosing furnace. The molten metal is stored in a molten state in the dosing furnace ready for delivery to the mold. A metered amount of molten metal is delivered to the mold. To produce a high quality cast metal product, a clean molten metal must be delivered to the casting chamber. Furthermore, the inlet of the dosing tube is very small so to increase the service life of the dosing tube, a clean molten metal must enter the dosing tube en route to the casting chamber.

A clean molten metal must be delivered to the mold also to produce a high quality cast metal product. Integrity, properties, and surface appearance are important qualities of aluminum cast foundry alloy components as well as other metals used in automotive, electronic, appliance, and other exacting applications. Filtering impurities, such as oxide inclusions and intermetallic sludge, eliminates hard spots that the impurities may cause in machining. Some prior art attempts have been made to filter the molten metal prior to entry into the dosing tube. U.S. Pat. No. 5,370,171 discloses an exit filter that the metal flows through prior to entering a suction tube. The patent discloses a subcompartment into which a suction tube is placed. The subcompartment has solid walls and a filter at its bottom where the metal is required to flow through prior to entering the subcompartment and then the suction tube. The patent discloses that the filter could be placed on a bottom of the suction tube, but, according to the patent, the subcompartment is preferred because it permits the use of a larger expanse of the filter. Hence, a need arose to provide a large surface area filter that can attach directly to the bottom of a dosing tube.

Furthermore, the inlet orifice of the dosing tube is exceptionally small. Any filtering device cannot plug this orifice and it must permit substantial metal flow when the furnace unit is pressurized to deliver a precise quantity of molten metal through the dosing tube into the casting apparatus. The filter configuration herein described satisfies and overcomes this restraint.

SUMMARY OF THE INVENTION

The invention includes an apparatus for filtering molten metal held in a vessel before the metal enters the dosing tube. The filter apparatus includes an attachment portion that mounts to the dosing tube. The filter apparatus also includes a filter body extending from the attachment portion to provide a substantial portion of the filtering surface area. The attachment portion can be annular with an opening adapted to mount to an outer diameter of the dosing tube. The filter body can include a cylindrical portion that is attached to the annular attachment portion, and a planar end surface that covers the end of the cylindrical portion opposite the attachment portion. The planar end surface can be beveled.

The filter can be made from a bonded-particle material made from silicon carbide or aluminum oxide held together by an aluminum-resistant binder. The filter usually has a shorter life span than the service life of the dosing tube, and is therefore removable from the dosing tube.

A method for casting a metal product from a filtered molten metal includes providing molten metal in a vessel and placing a dosing tube in the vessel, where the dosing tube provides fluid communication between the vessel and a chamber in a molding or casting operation. The method also includes mounting a filter on an inlet end of the dosing tube and drawing molten metal through the filter, through the dosing tube to the chamber in the molding operation.

DETAILED DESCRIPTION OF THE INVENTION

According to the present invention, a vessel or dosing furnace 1 holds molten metal, which according to the preferred embodiment is a molten ferrous or nonferrous material particularly, but not limited to aluminum. An outlet or dosing tube 2, also known in the art as a suction tube or a shot tube, is mounted on the vessel. The dosing tube leads to the molding or casting operation 3. The dosing tube can be mounted at an angle, preferably between 30–45 degrees, with a lower end of the dosing tube positioned above the floor of the vessel. The dosing tube is made of a heat resistant material that can withstand the molten metal environment. The material from which the dosing tube is made is also chosen so as not to contaminate the molten metal in the vessel. Such material includes graphite, silicon carbide, silicon nitride, aluminum titanate or other advanced ceramics. The filter apparatus of the present invention can attach to the lower end of the dosing tube, preferably by attaching to an outer periphery of the dosing tube.

The molten metal stored in the dosing furnace passes through the dosing tube en route to the casting apparatus. To filter out impurities that may effect the finished cast product, a filter can be attached to an inlet end of the dosing tube.

Figure 1:
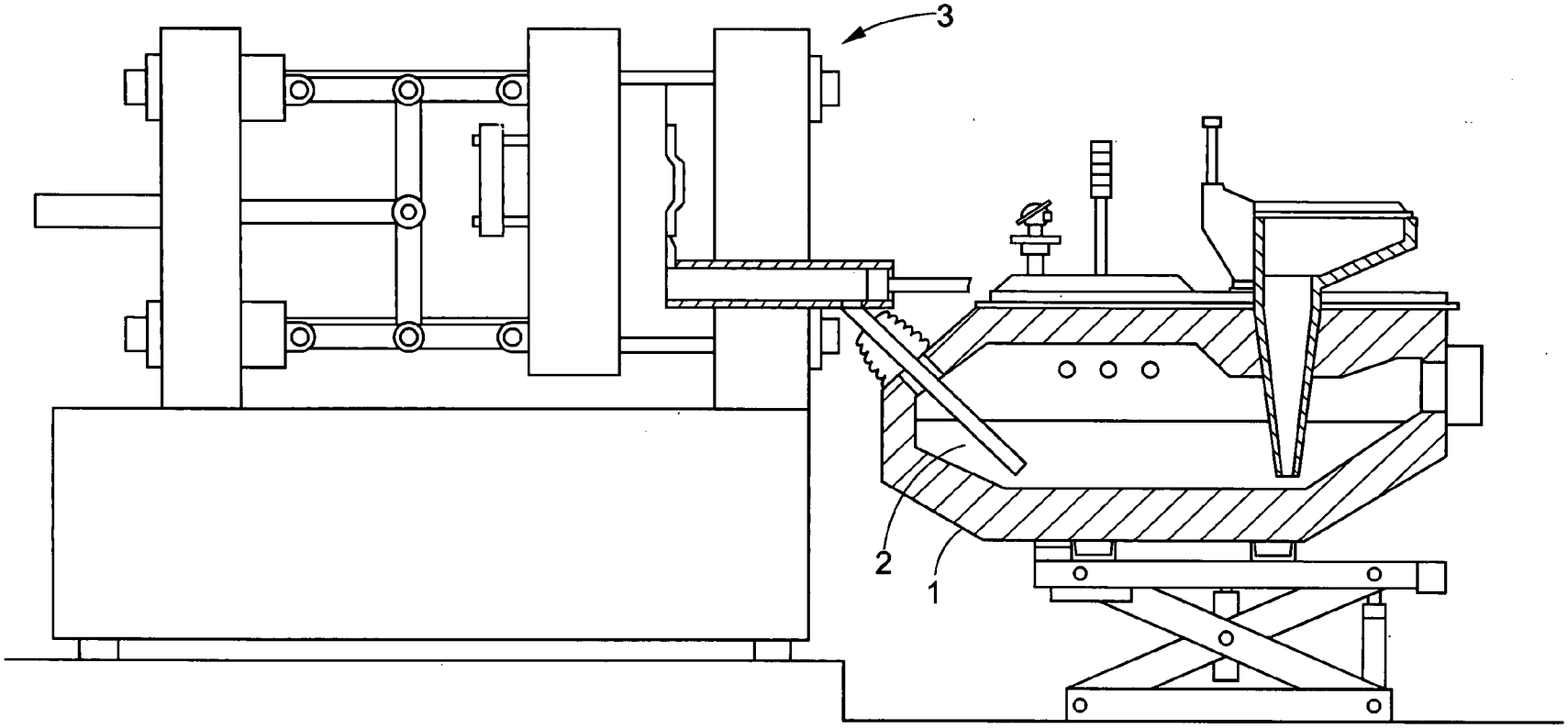
FIG. 1 is a schematic of a dosing furnace incorporating the invention.
Figure 2:
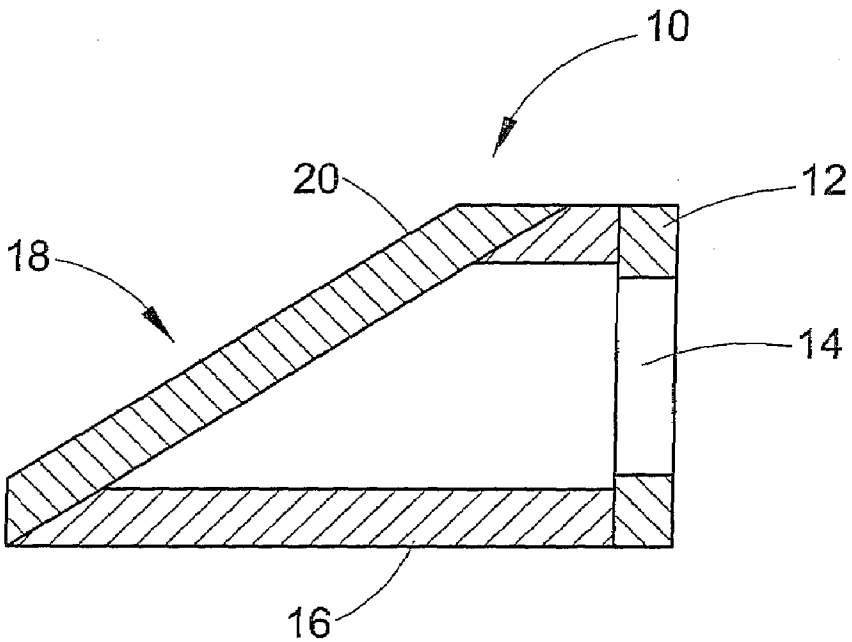
FIG. 2 is a sectional elevation view of the inventive filter.
Figure 3:
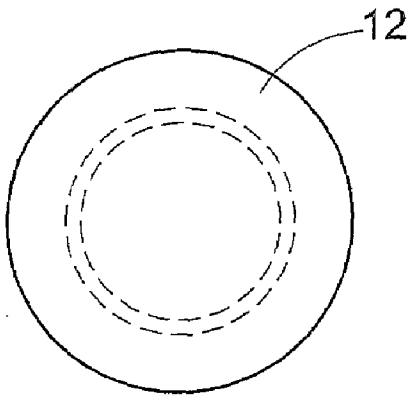
FIG. 3 is an end view of the filter of FIG. 2.

As seen in FIGS. 2 and 3 the filter apparatus 10 includes an mounting or attachment portion 12 having an opening 14 to fit around the outside of the dosing tube. The filter apparatus also includes a filtering surface area or filter body 16 defining an enclosure. The inlet end of the dosing tube will reside in this enclosure when the filter apparatus is mounted on the dosing tube. The filter apparatus 10 can be a bonded-particle filter made of discrete particles of silicon carbide or aluminum oxide and an aluminum-alloy resistant binder system. The bonded-particle filter is less porous than other filter materials and contains a greater number of tortuous, interconnected pathways. Therefore, there are many more chances to capture inclusions as the molten metal flows through the filter. Also, the binder system has the capability to hold on to inclusions, even with repeated usage. The filter apparatus could be made of another material as well, so long as the material filters out impurities from the metal before the metal reaches the inlet orifice of the dosing tube and allows enough flow so as not to effect the casting operation.

The filter apparatus can take many forms including spherical and cubic shapes. The shape chosen is one that can maximize the surface area of the filter in the space provided between the end of the dosing tube and the bottom of the dosing furnace. In the embodiment depicted in the FIGS., the filter apparatus is generally cylindrical in shape having a beveled end.

The mounting portion 12 can be any shape and in the preferred embodiment it is substantially annular. The mounting portion allows the filter apparatus to mount directly to the dosing tube and it provides a base for the remainder of the filter apparatus and its filtering surface area. The mounting portion defines an opening 14 that receives the dosing tube.

The opening 14 can be sized to receive the dosing tube, however the fit need not be perfect. Any gap in the space between the mounting portion and the dosing tube can be filled with gasket material, cement or the like. Nevertheless, the opening will usually be shaped similarly to the outside of the dosing tube so that the opening can more easily receive the dosing tube.

A central portion or filter body 16 attaches to the mounting portion 12. The central portion provides the large amount of surface area for the filter apparatus. The central portion may take any shape, including spherical and cubic, with the purpose of the central portion to provide as much filter surface area as practical. The central portion may have a beveled end 18 opposite the mounting portion, and the filter body in the embodiment in the FIGS. is substantially cylindrical having a beveled end.

Since the dosing tube is usually mounted at an angle, the beveled end 18 can provide more surface area for the filter apparatus by maximizing the amount of space available between the end of the tube and the floor of the vessel. Furthermore, since in the preferred embodiment the dosing tube is mounted at an angle, the beveled end can allow the filter apparatus to lie flatly on the bottom of the vessel.

A planar surface 20 attaches to the beveled end 18 of the filter apparatus 10 closing the filter body. The planar surface 20 can either lie on the bottom of the vessel or it can provide additional surface area to the filter apparatus. The angle of the bevel is usually controlled by the angle at which the dosing tube is oriented in the vessel.

The life span of the filter is usually shorter than the service life of the dosing tube; therefore the filter must be removed and replaced from the dosing tube upon servicing. An example of a method to attach the filter apparatus 10 to the end of a dosing tube includes, first applying cement around the outer periphery of the tube. An example of the cement is Frakset Cement, available from Metaullics Systems Co., L.P., 31935 Aurora Road, Solon, Ohio 44139. Next, a gasket is placed around the tube over the cement. An example of the gasket is Unifrax® Ceramic Fiber Paper. Next, more cement can be placed over the gasket. Finally, the filter is placed over the cement surrounding the gasket. To remove the filter apparatus, pull the dosing tube 2 out of the opening 14 in the filter apparatus, remove the gasket and, if necessary, chip away any cement that remains attached to the dosing tube.

The invention has been described with reference to the preferred embodiments. Obviously, modifications and alterations will occur to others upon a reading and understanding of this specification without departing from the spirit and scope of the invention described herein. The invention is intended to include all such modifications and alterations insofar as they come within the scope of the appended claims or the equivalents thereof.

Having thus described the invention, it is claimed:

1. An apparatus for filtering molten metal before entering a dosing tube, the apparatus comprising a mounting portion; a filter body connected to the mounting portion, the filter body having a beveled end opposite the mounting portion; and a surface attached to and substantially covering the beveled end.

2. The apparatus of claim 1 wherein the mounting portion is dimensioned to fit around the dosing tube.

3. The apparatus of claim 1 wherein the filter body is substantially cylindrical.

4. An apparatus for filtering molten metal held in a vessel before the metal enters a dosing tube, the apparatus comprising:

an attachment portion dimensioned to attach to a dosing tube; and a closed filtering surface area attached to and extending from the attachment portion to provide a filtering surface, the closed filtering surface area comprises a cylindrical portion having a beveled end distal the attachment portion and a planar surface attached to the beveled end.

5. The apparatus of claim 4 wherein the attachment portion is annular.

6. The apparatus of claim 1 wherein the surface attached to and substantially covering the beveled end is substantially planar.

7. The apparatus of claim 1 wherein the filter body comprises:

silicon carbide or aluminum oxide; and an aluminum-alloy resistant binder.

8. An apparatus for filtering molten metal, the apparatus comprising:

a vessel for holding molten metal;

a dosing tube disposed in the vessel; and a filter attached to the dosing tuber, wherein the filter includes a beveled end.

9. The apparatus of claim 8 wherein the filter is mounted onto an inlet end of the dosing tube.

10. The apparatus of claim 8 wherein the filter is cemented to the dosing tube.

11. The apparatus of claim 8 wherein the filter rests on a bottom floor of the vessel.

12. The apparatus of claim 11 wherein the beveled end rests on the bottom floor of the vessel.

13. The apparatus of claim 8 wherein the dosing tube is disposed at an angle to vertical.

* * * * *